United States Patent [19]

Lunn

[11] 3,963,526

[45] June 15, 1976

[54] METHOD OF IMPARTING INCREASED DEZINCIFICATION RESISTANCE TO BRASS

[75] Inventor: Borge Lunn, Rodovre, Denmark

[73] Assignee: Aktieselskabet Nordiske Kabel-OG Traadfabriker, Copenhagen, Denmark

[22] Filed: July 10, 1974

[21] Appl. No.: 487,138

Related U.S. Application Data

[63] Continuation-in-part of Ser. No. 282,864, Aug. 22, 1972, abandoned.

[52] U.S. Cl. ..... 148/2; 75/157.5; 148/11.5 R

[51] Int. Cl.[2] ..... C22D 1/16

[58] Field of Search ..... 148/2, 11.5 R; 75/157.5

[56] References Cited

UNITED STATES PATENTS 2,118,688 5/1938 Webster ..... 75/155

3,005,702 10/1961 Chaudron et al. ..... 75/63

FOREIGN PATENTS OR APPLICATIONS 575,316 2/1946 United Kingdom ..... 75/157.5

*Primary Examiner*—W. Stallard

*Attorney, Agent, or Firm*—Pennie & Edmonds

[57] ABSTRACT

A method in which to a brass containing 61–66% of copper there is added 0.02% of an alloying element such as arsenic, antimony or phosphorus and up to 4% of lead and in the case of chill casting and pressure die casting alloys 0.05–0.8% of aluminum, the remainder being zinc and usual impurities from the raw materials used, and in which the alloy after chill casting, pressure die-casting or sand casting, after extrusion or, where applicable, after hot pressing of parts cut from extruded rods, is heated to a temperature in the interval between 450 and 600° Celcius for a period so selected that the β-crystals are broken up, thus avoiding the occurence of a coherent structure of β-crystals through the brass.

7 Claims, 1 Drawing Figure

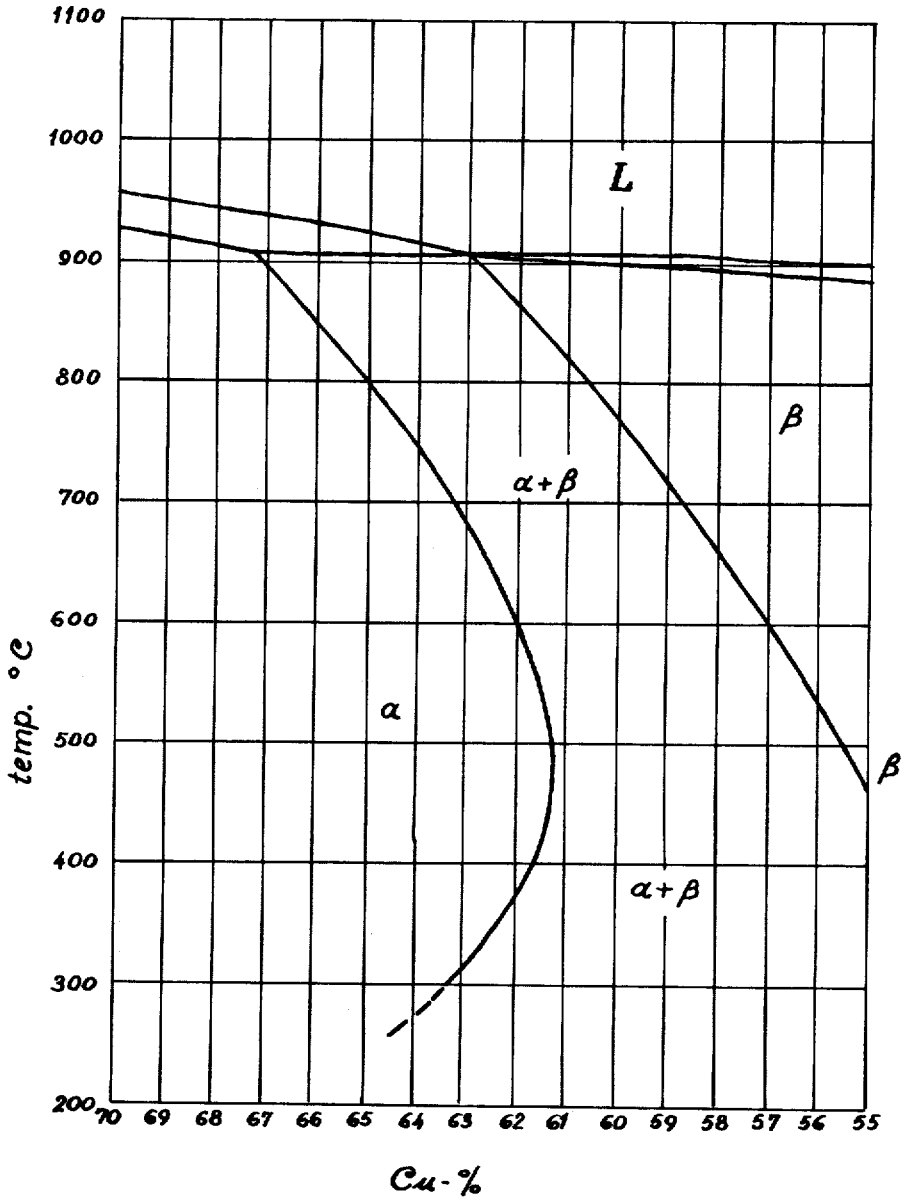
1100
1000
900
800
700
600
500
400
300
200
temp. °C
L
β
α+β
α
β
α+β
70 69 68 67 66 65 64 63 62 61 60 59 58 57 56 55
Cu-%

METHOD OF IMPARTING INCREASED DEZINCIFICATION RESISTANCE TO BRASS

CROSS REFERENCE TO RELATED APPLICATION

This application is a Continuatin-In-Part of my earlier filed application Ser. No. 282,864 filed Aug. 22, 1972 now abandoned.

BACKGROUND OF THE INVENTION

The present invention relates to a method of imparting increased dezincification-resistance to brass.

Brasses are alloys of copper and zinc. When containing up to 37% (in this specification % is understood to mean percent by weight) of zinc the alloys are so-called $\alpha$-alloys, which are solid solutions built up of homogeneous crystals with a face-centred cubic lattice. Such an $\alpha$-brass possesses good cold-working properties, it can be subjected to rolling, stamping and upsetting in the cold condition, but it is rather more difficult in hot working, especially if it contains lead, which is often added to increase its machining properties.

One of the causes of the wide-spread application of brass is the good resistance of this type of alloy to corrosion in air and water, but under certain circumstances, especially if brass is exposed to soft, chloride-containing water and particularly in hot surroundings, brass will corrode in a special way called dezincification, which manifests itself in a dissolution of the zinc content, while the dissolved copper is reprecipitated as a spongy, porous mass without strength and with a tendency to develop through perforations, so that e.g. brass fittings for water piping may become leaky under pressure and unfit for further use, when dezincification corrosion sets in.

It is known that dezincification of $\alpha$-brass can be prevented, if small quantities of arsenic, antimony or phosphorus in the range of 0.01% or upwards are added to the alloy. On account of the great ductility of the $\alpha$-brasses in the cold condition they are used particularly for the production of sheet, strip, tube, and wire for cold upsetting purposes, e.g. for nails, screws and the like.

At increased zinc content, i.e. from approx. 37% another form of crystal will appear, the so-called $\beta$-crystal, which has a body-centered cubic lattice.This $\beta$-crystal is distinguished by a considerably better ductility in the hot condition than in the cold, and alloys containing $\beta$-crystals are therefore particularly useful for hot-forging and hot-extrusion of sections and rods and also more useful for pressure die-casting, chill casting and sand casting than $\alpha$-brass. This type of alloy may contain several percent of lead for the benefit of its machining properties without adversely affecting its hot working properties.

This type of alloy usually contains 63 – 56% of copper, the remainder being zinc and lead. As regards corrosion these alloys are resistant to the influences of water and air, too, but when subjected to dezincification-promoting surroundings it is not posible to prevent dezincification by the addition of small amounts of antimony, phosphorus or arsenic on account of the content of $\beta$-crystals, which increases with decreasing copper content. For a brass containing e.g. 58% of copper the $\beta$-quantity will be about 30%, and even if the said dezincification-preventing agents have been added to a brass with such content, it will corrode vigorously under conditions favouring dezincification, because the 30% $\beta$-phase forms a coherent structure in the alloy and cannot be protected against dezincification. Even at small quantities of $\beta$-phase this phase forms a sort of network through the structure, so that alloys with small $\beta$-quantities cannot be protected against dezincification by means of the said alloy additions.

DETAILED DESCRIPTION OF THE INVENTION

The object of the present invention is to provide a method by which a brass can be produced which will stand cold deformation by rolling, upsetting, drawing or the like, as well as hot deformation such as extrusion, hot-forging or the like, and which is also useful for pressure die-casting, chill casting and sand casting, and yet is resistant to dezincification corrosion.

According to the present invention this object is achieved by adding to an alloy containing 61 – 66% of copper at least 0.02% of an anti-dezincification agent such as arsenic, antimony or phosphorus and up to 4.0% of lead, and in the case of chill casting and pressure die-casting alloys 0.05–0.8% of aluminum, the remainder being zinc and usual impurities from the raw materials used, including possibly scrap metal, and by heating after chill casting, pressure die-casting or sand casting, after extrusion or, when applicable, after hot pressing of parts cut from extruded rods, the alloy to a temperature in the interval between 450° and 600°C for a period, the temperature and the period being so chosen that the $\beta$-crystals are broken-up to such a degree that the coherent structure thereof ceases to exist.

When contemplating the relevant part of a copper-zinc diagram for copper contents of e.g. 70 – 55% it will appear that at higher temperatures, e.g. 700° – 850°C, $\beta$ will be present even at a copper content up to 66%, whilst at temperatures of approximately 450°C the maximum presence of $\alpha$ will be found at a copper content as low as approximately 61%, while at lower temperatures a maximum quantity of $\alpha$ will be present down to approximately 63% of copper.

This means that at a minimum of 61% of copper content in the hot condition at temperatures above 650° – 700°C, so much $\beta$ may be present in the alloy that it must be expected to be sufficiently deformable in the hot condition for extrusion and hot-forging, which also proves to be the case. Furthermore, a sufficiently slow cooling or a sufficiently long heat treatment will result in a complete transformation of the $\beta$-crystals in conformity with the diagram, if the alloy is kept for a sufficiently long period of time at temperatures of e.g. at least 450°C, when the copper content is 61%, and preferably higher temperatures for higher copper contents. Small quantities of antimony, phosphorus or arsenic added to such an alloy in accordance with the limits set out above, render the alloy substantially completely resistant to dezincification.

However, very long periods of annealing are necessary to obtain conditions corresponding to the equilibrium diagram. In the case of extrustion as well as hot-forging and also pressure die-casting, chill casting and sand casting of alloys in the range of 61–65% of copper, the quantity of $\beta$-crystals formed will not be transformed on account of the relatively rapid cooling from the working or casting temperature, but the structure shows a more or less coherent quantity of $\beta$-crystals, amounting to 20–5% of the area. In a cross-section of an extruded rod the said crystals will only have negligible contact with each other, but in the longitudinal structure they appear as long, needle-shaped stringers having sporadic mutual contact through the α-structure. Similar conditions will obtain in cast structures, whether use has been made of pressure diecasting, chill casting or sand casting. When heated for a suitable period of time, depending on composition and structure, to temperatures between 450° and 600°C the coherent β-crystals will disintegrate into individual particles, so that the through going network of β-crystals is broken up into individual areas without direct connection with each other. Hitherto, no attention has been paid to this effect, but it has the consequence that an attack of dezincification enters the surface only to a negligible degree and comes to a stop because there is no connection from the β-crystals of the surface to the subjacent material content of untransformed but mutually independent, lengthy β-crystal particles.

In a preferred embodiment of the present invention the anti-dezincification agent is arsenic. While the same effect on corrosion may be obtained by other agents such as antimony or phosphorus, these other agents have some side effects, which make their presence in the alloy less desirable.

The drawing shows a section of the copper-zinc diagram for alloys containing from 70 to 55% of copper.

A brass alloy having the desired properties is obtained with copper contents between 61 and 66%. A typical alloy for extrusion is a brass having 62.5% of copper, not more than 4% of lead and at least 02% of arsenic, the remainder being zinc and usual impurities from the raw materials used, including possibly scrap metal. After extrusion, and, if desired, after subsequent hot-pressing of parts cut from extruded rods, a heating to the temperature interval of 450° – 600°C for a suitable period of time will breakup the coherent β-crystals, so that the through-going connection ceases to exist.

Brass alloys for chill casting and pressure-die-casting will behave correspondingly. Such alloys normally contain from 0.05% to 0.85 of aluminum, and a typical alloy is a pressure die-casting alloy containing e.g. 63.5% of copper, 0.2% of aluminum, maximum 4% of lead and minimum 0.02% of arsenic, the remainder being zinc and normal impurities from the raw materials used, including possibly scrap metal. After the said heat treatment an alloy of this type will have a structure with mutually separated, small β-crystals.

The dezincification tests according to the Swedish VA building standard, in which the samples are exposed to a solution of 10 grams of copper chloride in 1000 ml of distilled water for 150 hours at 70° – 80°C, alloys thus treated will not only obtain the prescribed greyish green colour without copper-coloured precipitations, but will also in metallographic examination reveal depths of dezincification not exceeding 10–100μm, whereas alloys of the same composition having received no heat treatment will have depths of dezincification exceeding one millimeter after exposure to the said test.

EXAMPLE I

A brass alloy was prepared containing 62% copper, 2% lead, 0.05% arsenic with the balance being zinc. This alloy was cast into billets which were then extruded hot into rods at a temperature maintained at 700° – 750°C range. The extruded rods after cooling were reheated to 500°C and held at that temperature for four hours after which they were cooled slowly in the air. After cooling the rods were drawn and machined to form valve stems. Before the reheating treatment the structure showed longitudinal stringers of beta-crystals arranged with a general orientation in the direction of extrusion. After heat treatment the structure was normallized with only a few separate beta-crystals being visible. Any attack on this product will attack only the localized beta-crystals leaving the inhibited alpha-phase unattacked.

EXAMPLE II

The extruded rods of Example I were cut into pieces and reheated for hot-stamping of parts at a temperature held in the range of about 750° – 800°C. After the hot-stamping of the parts and cooling they were reheated to 500°C and held at that temperature for four hours. Again, after the heat treatment there are only small discrete particles of beta-crystals which are not interconnected and, as such, the whole part is resistant to dezincification even under the most severe conditions.

Table I below shows Examples 3 through 10 in which various brass alloys were used to produce various products in different ways including extrusion, hot-stamping, cold drawing and various casting systems.

TABLE I

| | Composition | | | | | Product | Structure before H.T. | Heat treatment | | Structure after H.T. | Dezincification |
|---|---|---|---|---|---|---|---|---|---|---|---|
| | Cu | Pb | Al | AS | Zn+Imp. | | % Beta | Time hours | Temp. °C | | |
| 3 | 62 | 2 | 0 | 0.04 | Bal. | 2" extruded rod | 10 | 8 | 550 | Alpha + isolated traces of Beta | Nil |
| 4 | 62 | 2 | 0 | 0.04 | Bal. | " | 10 | 10 | 550[2] | " | Nil |
| 5 | 62 | 2 | 0 | 0.04 | Bal. | ½" extr. rod, cold drawn | 10 | 2 | 550 | " | Nil |
| 6 | 62 | 2 | 0 | 0.04 | Bal. | Hot stamped from 1" rod | 6 | 1 | 525 | " | Nil |
| 7 | 61 | 4 | 0 | 0.07 | Bal. | ⅜" extr. rod, cold dr. | 12 | 3 | 530 | " | Nil |
| 8 | 64 | 1 | 0.2 | 0.04 | Bal. | Pressure die-casting | 8 | 4 | 550 | " | Nil |
| 9 | 66 | 1.5 | 0.4 | 0.05 | Bal. | Gravity die-casting | 6 | 2 | 575 | " | Nil |
| 10 | 66 | 2 | | 0.10 | Bal. | Sand casting | 4 | 1 | 575 | " | Nil |

[2] This heat-treatment consists of cooling from the extrusion temperature (720°C) to 550°C and maintaining that temperature the whole time of operation is thus 10 hours.

The dezincification was determined by the above-mentioned Swedish VA tests, however, similar results have been achieved with the BNF test which utilizes aggressive hot water supply and similarly with a potentiostatic test of the Danish Corrosion Centre.

Applicant has also found, as indicated in Example 4 above, that it is not necessary to first cool the hot extruded or hot-pressed or otherwise hot formed alloys and then to reheat the same. It is possible, as with Example 4, to cool from the high temperature of the forming such as extrusion (720°C in Example 4) to the heat treating temperature of, say, 550°C as was done in Example 4 and then to hold that temperature until there remains only the isolated traces of beta-crystals. In this way the process is more efficient in that reheating is not required and the heat from the original extrusion is utilized in part for the heat treatment.

Other tests on these alloys and products indicate that by continuing the heat treatment for between about four and five times the length of time set forth in Table I, the beta components may be completely removed. However, complete removal is not necessary to achieve the great improvement in dezincification, it being only necessary to treat until there are only isolated traces of beta particles as shown in Table I.

While temperatures in the range of 450°C – 600°C may be utilized for this heat treatment, it will be appreciated that the time may vary with the temperature. For example, at 450°C Example I above would require about 48 hours to achieve sufficient breakup of the beta component structure to render it equally resistant to dezincification as the treatment at 500°C for four hours which was performed in Example I. In the interest of economy it is preferred to perform the heat treatment in the range 475°C – 575°C, and in many instances, the range 500° – 550°C has been found both most economical and convenient.

While anti-dezincification agents such as arsenic have been added to brass for many years such agents alone are not sufficient for protection of the alloys disclosed above under the conditions of the severe tests described above. From the above it will be seen that applicant has discovered that in brass alloys containing 61 – 66% copper and a small quantity of anti-dezincification agent the same may be greatly enhanced in their resistance to dezincification by heating in the range 450° – 600°C until breakup of the beta-crystal structure into individual units is achieved.

I claim:

1. The method of making a brass alloy of the type consisting essentially of primary zinc and from 61 to 66 per cent by weight of copper, suitable for casting, extruding and working and of imparting increased dezincification-resistance to the resulting brass product, said method comprising the steps of initially including in the alloy a small proportion of at least 0.02 per cent by weight of an anti-dezincification agent, and subjecting the resulting brass alloy product to heat treatment in the temperature range of from 450° to 600°C., and continuing the heat treatment at the selected temperature for a period of time sufficient to breakup the beta crystal structure normally formed in the brass alloy into individual units in the alloy and without mutual coherence throughout the alloy product.

2. The method according to claim 1, including the step of adding up to about 4 per cent by weight of lead to the alloy composition.

3. The method according to claim 1, including the step of adding from 0.05 to 0.8 per cent by weight of aluminum to the alloy composition.

4. The method according to claim 1, wherein said anti-dezincification agent is arsenic.

5. The method according to claim 1, wherein the anti-dezincification agent is present in at least 0.02 per cent by weight and is selected from the group consisting of arsenic, antimony and phosphorus.

6. The method according to claim 1 wherein prior to said heat treatment, said alloy is first hot formed at a temperature above the temperature of said heat treatment and then cooled to the heat treatment range but not below and then held at the heat treatment range for said period of time sufficient to breakup the beta-crystal structure.

7. The method of claim 1, wherein prior to said heat treatment said alloy is first hot formed at a temperature above the temperature of said treatment and then allowed to cool to a temperature below the temperature of said heat treatment and subsequently reheated to the temperature of said heat treatment for said period of time sufficient to breakup the beta-crystal structure.

* * * * *